US007992717B1

(12) United States Patent
Hazen

(10) Patent No.: US 7,992,717 B1
(45) Date of Patent: Aug. 9, 2011

(54) HINDERED SETTLING SYSTEM

(76) Inventor: Jay T. Hazen, Lakeland, FL (US)

( * ) Notice: Subject to any disclaimer, the term of this patent is extended or adjusted under 35 U.S.C. 154(b) by 40 days.

(21) Appl. No.: 12/291,085

(22) Filed: Nov. 6, 2008

(51) Int. Cl.
*B03B 5/66* (2006.01)

(52) U.S. Cl. ..... 209/158; 209/160; 209/172; 209/172.5; 209/173

(58) Field of Classification Search ..... 209/160, 209/172, 172.5, 173, 158, 164
See application file for complete search history.

(56) References Cited

U.S. PATENT DOCUMENTS 2,033,008 A * 3/1936 Remick ..... 209/160
2,733,810 A * 2/1956 Murry ..... 209/172.5
3,511,375 A * 5/1970 Lang ..... 209/454
3,885,331 A * 5/1975 Mathieu ..... 37/344
4,029,568 A * 6/1977 Pittman et al. ..... 208/415
4,405,454 A 9/1983 Hultsch
4,851,036 A * 7/1989 Anthes et al. ..... 209/164
5,589,599 A * 12/1996 McMullen et al. ..... 585/240
5,831,149 A * 11/1998 Webb ..... 73/40.5 R
6,425,485 B1 * 7/2002 Mankosa et al. ..... 209/164
7,147,111 B2 * 12/2006 Fendley ..... 210/522
2005/0051500 A1 * 3/2005 Price et al. ..... 210/767

* cited by examiner

*Primary Examiner* — Terrrell H Matthews

(57) ABSTRACT

A housing adapted to receive a flow of slurry has a central section, an upper section, and a lower section. A clean water introduction assembly has a horizontal manifold, a plurality of horizontal apertured pipes and a plurality of vertical water lines. A valve assembly has an upper valve and a lower valve. The upper valve is normally open. The lower valve is normally closed to feed clean water from the manifold through the water lines and out of the apertured pipes into the housing. In this manner water entering the housing will cause a hindered settling. The valve assembly is also operable in a back flow mode with the upper valve being closed and the lower valve being opened. In this manner water from the housing will flow from the apertured pipes. In this manner clogs in the holes of the apertured pipe are cleared. A coupling assembly is provided.

2 Claims, 4 Drawing Sheets

HINDERED SETTLING SYSTEM

BACKGROUND OF THE INVENTION

1. Field of the Invention

The present invention relates to a hindered settling system and more particularly pertains to separating a primary flow of slurry into a secondary flow of water with heavy particulate matter and a tertiary flow of water with light particulate matter, the separating being done in a safe, ecological, convenient and economical manner.

2. Description of the Prior Art

The use of settling systems of known designs and configurations is known in the prior art. More specifically, settling systems of known designs and configurations previously devised and utilized for the purpose of separating water and particulate matter through known designs and configuration are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,405,454 issued Sep. 20, 1983 to Hultsch relates to a Process and Apparatus for the Dewatering of Solids in Suspension. Further, U.S. Pat. No. 7,147,111 issued Dec. 12, 2006 to Fendley relates to a Hindered-Settling Fluid Classifier.

While these devices fulfill their respective, particular objectives and requirements, the aforementioned patents do not describe a hindered settling system that allows for separating a primary flow of slurry into a secondary flow of water with heavy particulate matter and a tertiary flow of water with light particulate matter, the separating according to the present invention being done in a safe, ecological, convenient and economical manner.

In this respect, the hindered settling system according to the present invention substantially departs from the conventional concepts and designs of the prior art, and in doing so provides an apparatus primarily developed for the purpose of separating a primary flow of slurry into a secondary flow of water with heavy particulate matter and a tertiary flow of water with light particulate matter, the separating being done in a safe, ecological, convenient and economical manner.

Therefore, it can be appreciated that there exists a continuing need for a new and improved hindered settling system which can be used for separating a primary flow of slurry into a secondary flow of water with heavy particulate matter and a tertiary flow of water with light particulate matter, the separating being done in a safe, ecological, convenient and economical manner. In this regard, the present invention substantially fulfills this need.

SUMMARY OF THE INVENTION

In view of the foregoing disadvantages inherent in the known types of settling systems of known designs and configurations now present in the prior art, the present invention provides an improved hindered settling system. As such, the general purpose of the present invention, which will be described subsequently in greater detail, is to provide a new and improved hindered settling system and method which has all the advantages of the prior art and none of the disadvantages.

To attain this, the present invention essentially comprises a hindered settling system. First provided is a housing adapted to receive a flow of slurry. The housing has a central section, an upper section and a lower section.

A clean water introduction assembly is provided. The clean water introduction assembly has a horizontal manifold. The horizontal manifold is provided in proximity to the upper section. The clean water introduction assembly has a plurality of horizontal apertured pipes. The pipes are provided in the central section in proximity to the lower section. The clean water introduction assembly has a plurality of vertical water lines. The water lines are coupled to the manifold and an associated apertured pipe.

Next provided is a valve assembly. The valve assembly includes an upper valve in each water line adjacent to the manifold. The valve assembly includes a plurality of flush valves each of which is coaxial and in communication with both an associated apertured pipe and an associated water line. The valve assembly also includes a lower valve in each flush valve. The upper valve is normally open and the lower valve is normally closed during an operation mode. During the operation mode clean water will flow from the manifold through the water lines and out of the apertured pipes into the housing and slurry entering the housing will cause a hindered settling with a downward flow of water with heavy particulate matter and an upward flow of water with light particulate matter. The valve assembly is also operable in a back flow mode with the upper valve being closed and the lower valve being opened. In the back flow mode, water from the housing will flow from the apertured pipes and out of the back wash pipes for clearing clogs in the holes in the apertured pipe.

Next provided are quick release coupling assemblies between the housing and each apertured pipe. Each coupling assembly includes a circular aperture in the housing for each apertured pipe in the central section adjacent to the lower section. Each coupling assembly also includes a cylindrical interior component having an annular flange welded to each aperture. Each interior component has an internal passageway in a frusto-conical configuration. Each coupling assembly also includes an annular compression plate adjacent to each annular flange. Each coupling assembly also includes a swedge with an interior portion positionable within each interior component. Each swedge has an interior bore for receiving an apertured pipe and an exterior surface in a frusto-conical configuration larger than the internal passageway of the interior component. Each swedge has an exterior portion in an annular configuration between the compression plate and the annular flange. The interior component and the compression plate are fabricated of a rigid metallic material. The swedge is fabricated of urethane or other suitable material.

Lastly provided are aligned apertures in the compression plate and the swedge and the flange of the interior component. The apertures of the flange of the interior component are threaded. Bolts releasably couple the compression plate and the swedge to the flange of the interior component. In this manner tightening the bolts will compress the swedges for creating a water tight seal between the apertured pipes and the housing. Removing the bolts will allow for the quick release and uncoupling of the apertured pipes from the housing for repair or replacement.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hindered settling system which has all of the advantages of the prior art settling systems of known designs and configurations and none of the disadvantages.

It is another object of the present invention to provide a new and improved hindered settling system which may be easily and efficiently manufactured and marketed.

It is further object of the present invention to provide a new and improved hindered settling system which is of durable and reliable constructions.

An even further object of the present invention is to provide a new and improved hindered settling system which is susceptible of a low cost of manufacture with regard to both materials and labor, and which accordingly is then susceptible of low prices of sale, thereby making such hindered settling system economically available.

Even still another object of the present invention is to provide a hindered settling system for separating a primary flow of slurry into a secondary flow of water with heavy particulate matter and a tertiary flow of water with light particulate matter, the separating being done in a safe, ecological, convenient and economical manner.

Lastly, it is an object of the present invention to provide a new and improved hindered settling system adapted to receive a flow of slurry. The housing has a central section, an upper section, and a lower section. A clean water introduction assembly has a horizontal manifold, a plurality of horizontal apertured pipes and a plurality of vertical water lines. A valve assembly has an upper valve and a lower valve. The upper valve is normally open. The lower valve is normally closed to feed clean water from the manifold through the water lines and out of the apertured pipes into the housing. In this manner water entering the housing will cause a hindered settling. The valve assembly is also operable in a back flow mode with the upper valve being closed and the lower valve being opened. In this manner water from the housing will flow from the apertured pipes. In this manner clogs in the holes of the apertured pipe are cleared. A coupling assembly is provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
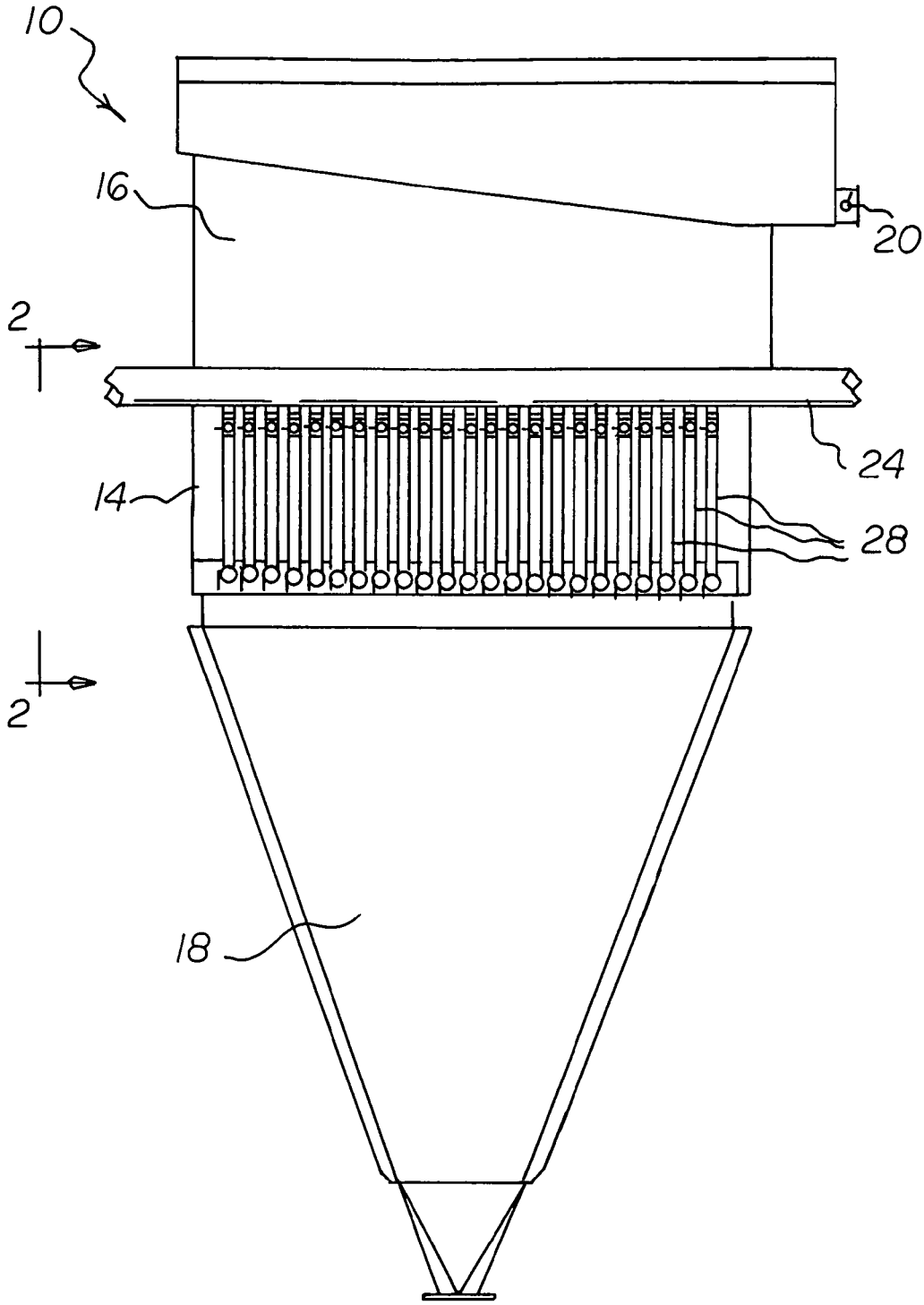
FIG. 1 is a front elevational view of a hindered settling system constructed in accordance with the principles of the present invention.
Figure 2:
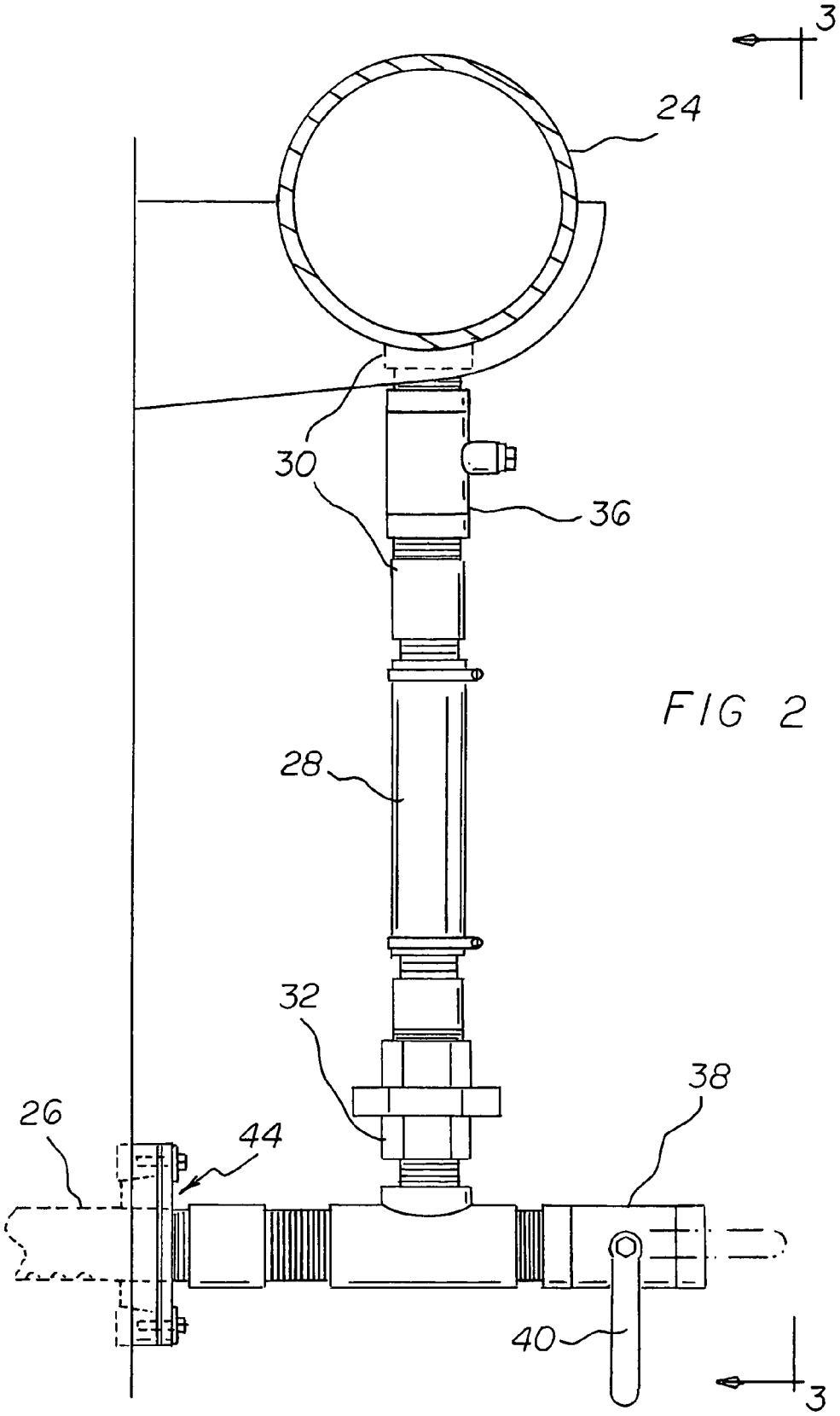
FIG. 2 is an enlarged side elevational view taken along line 2-2 of FIG. 1.
Figure 3:
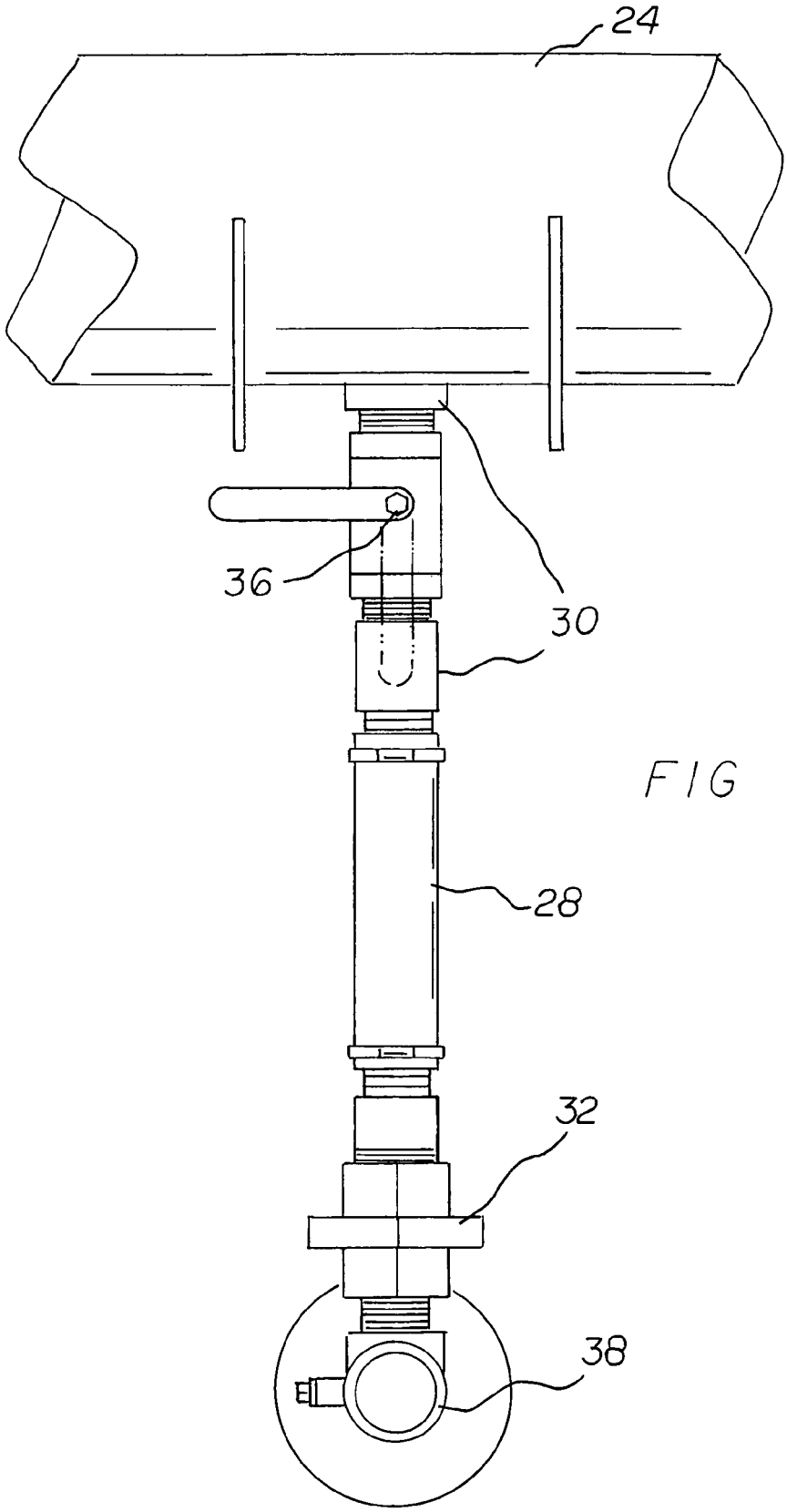
FIG. 3 is an enlarged front elevational view taken along line 3-3 of FIG. 2.
Figure 4:
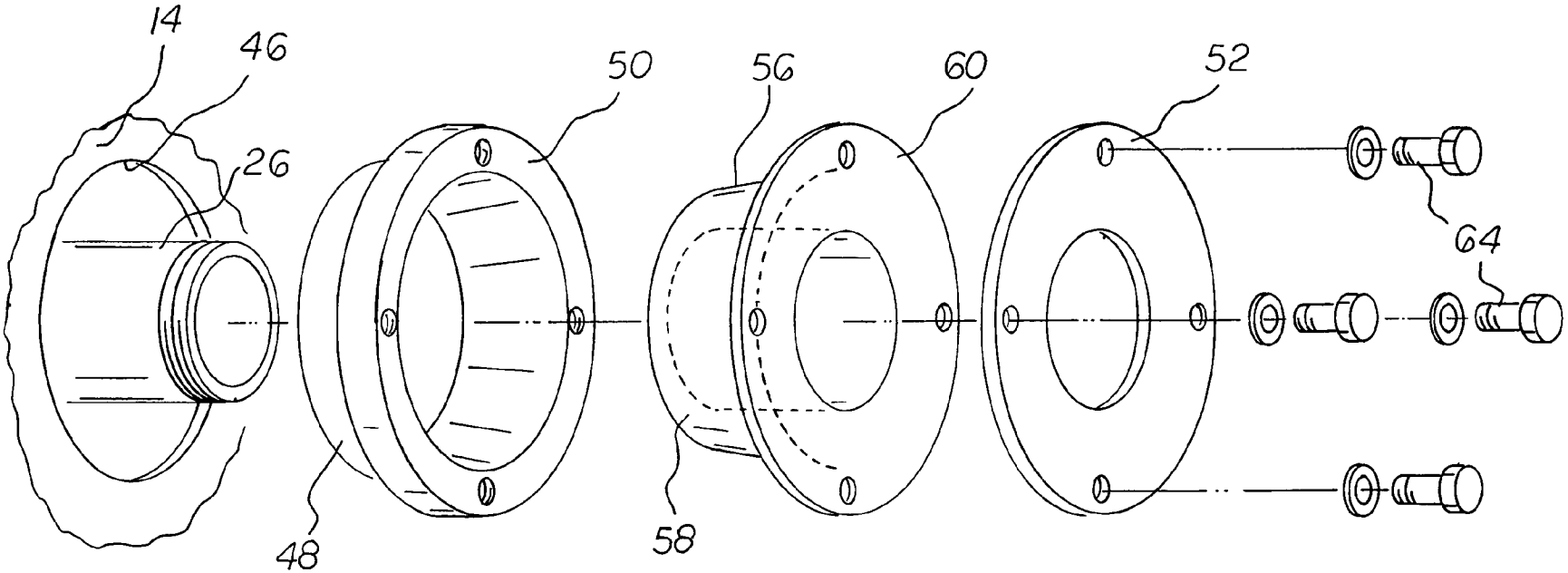
FIG. 4 is an exploded perspective illustration of a quick release coupling assembly of FIG. 2.

With reference now to the drawings, and in particular to FIG. 1 thereof, the preferred embodiment of the new and improved hindered settling system embodying the principles and concepts of the present invention and generally designated by the reference numeral 10 will be described.

The present invention, the hindered settling system 10 is comprised of a plurality of components. Such components in their broadest context include a housing, a clean water introduction assembly, a valve assembly and a coupling assembly. Such components are individually configured and correlated with respect to each other so as to attain the desired objective.

First provided is a housing. The housing includes a central section 14. The housing also includes an upper section 16 with a large upper opening for the receipt of a primary flow of slurry to be separated. The housing also includes a lower section 18 with a small lower opening for the discharge of a flow of water with heavy particulate matter for disposal. A lateral discharge line 20 in the upper section adjacent to the central section is provided for the discharge of a flow of water with light particulate matter.

Next provided is a clean water introduction assembly. The clean water introduction assembly includes a horizontal manifold 24 adjacent to the central section in proximity to the upper section. A plurality of horizontal apertured pipes 26 are provided in the central section in proximity to the lower section. Each of the apertured pipes is formed with a plurality of downwardly facing holes. The clean water introduction assembly also includes a plurality of vertical water lines 28. Each water line has an upper end 30 coupled to the manifold and a lower end 32 operatively coupled to an associated apertured pipe.

Next provided is a valve assembly. The valve assembly includes an upper valve 36 in each water line adjacent to the manifold. The valve assembly includes a plurality of flush valves 38 each of which is coaxial and in communication with both an associated apertured pipe and an associated water line. The valve assembly also includes a lower valve handle 40 in each flush valve. The upper valve is normally open and the lower valve is normally closed during an operation mode. During the operation mode clean water will flow from the manifold through the water distribution lines and out of the apertured pipes into the housing and slurry entering the housing upper section 16 will cause a hindered settling with a downward flow of water with heavy particulate matter and an upward flow of water with light particulate matter. The valve assembly is also operable in a back flow mode with the upper valve being closed and the lower valve being opened. In the back flow mode, water will flow from the apertured pipes and out of the back wash pipes for clearing clogs in the holes in the apertured pipe.

Next provided are quick release coupling assemblies 44 between the housing and each apertured pipe. Each coupling assembly includes a circular aperture 46 in the housing for each apertured pipe in the central section adjacent to the lower section. Each coupling assembly also includes a cylindrical interior component 48 having an annular flange 50 welded to each aperture. Each interior component has an internal passageway in a frusto-conical configuration. Each coupling assembly also includes an annular compression plate 52 adjacent to each annular flange. Each coupling assembly also includes a swedge 56 with an interior portion 58 positionable within each interior component 48. Each swedge has an interior bore for receiving an apertured pipe and an exterior surface in a frusto-conical configuration larger than the internal passageway of the interior component 48. Each swedge has an exterior portion 60 in an annular configuration between the compression plate and the annular flange. The interior component and the compression plate are manufactured of a rigid metallic material. The swedge is fabricated of urethane or other suitable material.

Lastly provided are aligned apertures in the compression plate and the swedge and the flange of the interior component 48. The apertures of the flange of the interior component 48 are threaded. Bolts 64 releasably couple the compression plate and the swedge to the flange of the interior component. In this manner tightening the bolts will compress the swedges for creating a water tight seal between the apertured pipes and the housing. Removing the bolts will allow for the quick release and uncoupling of the apertured pipes from the housing for repair or replacement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hindered settling system comprising:

a housing adapted to receive a flow of slurry, the housing including a central section and an upper section and a lower section;

a clean water introduction assembly including a horizontal manifold in proximity to the upper section, a plurality of horizontal apertured pipes in the central section in proximity to the lower section, a plurality of vertical water lines coupled to the manifold and an associated apertured pipe;

a valve assembly including an upper valve and a lower valve, the upper valve being normally open and the lower valve being normally closed to feed clean water from the manifold through the water lines and out of the apertured pipes into the housing whereby slurry and clean water entering the housing will cause a hindered settling, the valve assembly also operable in a back flow mode with the upper valve being closed and the lower valve being opened whereby water from the housing will flow from the apertured pipes for clearing clogs in the holes of the apertured pipe; and a coupling assembly between the housing and each apertured pipe;

wherein each coupling assembly includes a circular aperture in the housing for each apertured pipe in the central section adjacent to the lower section, a cylindrical interior component having an annular flange welded to each aperture, each interior component having an internal passageway in a frusto-conical configuration, an annular compression plate adjacent to each annular flange, a swedge with an interior portion positionable within each interior component, each swedge having an interior bore for receiving an apertured pipe and an exterior surface in a frusto-conical configuration larger than the internal passageway of the interior component, each swedge having an exterior portion in an annular configuration between the compression plate and the annular flange, the interior component and the compression plate being fabricated of a rigid metallic material, the swedge being fabricated of a resilient elastomer selected from the class of elastomers including plastic and rubber, natural and synthetic, and blends thereof, and further including aligned apertures in the compression plate and the swedge and the flange of the interior component, the apertures of the flange of the interior component being threaded, bolts releasably coupling the compression plate and the swedge to the flange of the interior component.

2. A hindered settling system for separating a primary flow of slurry into a secondary flow of water with heavy particulate matter and a tertiary flow of water with light particulate matter, the separating being done in a safe, ecological, convenient and economical manner, the system comprising, in combination:

a housing including a central section, an upper section with a large upper opening for the receipt of a primary flow of slurry to be separated, a lower section with a small lower opening for the discharge of a flow of water with heavy particulate matter for disposal, a lateral discharge line in the central section adjacent to the lower section for the discharge of a flow of water with light particulate matter;

a clean water introduction assembly including a horizontal manifold adjacent to the central section in proximity to the upper section, a plurality of horizontal apertured pipes in the central section in proximity to the lower section, each of the apertured pipes being formed with a plurality of downwardly facing holes, a plurality of vertical water lines, each water line having an upper end coupled to the manifold and a lower end operatively coupled to an associated apertured pipe;

a valve assembly including an upper valve in each water line adjacent to the manifold, a plurality of flush valves each of which is coaxial and in communication with both an associated apertured pipe and an associated water line, a lower valve in each flush valve, the upper valve being normally open and the lower valve being normally closed during an operation mode whereby clean water will flow from the manifold through the water lines and out of the apertured pipes into the housing and whereby slurry entering the housing will cause a hindered settling with a downward flow of water with heavy particulate matter and an upward flow of water with light particulate matter, the valve assembly also operable in a back flow mode with the upper valve being closed and the lower valve being opened whereby water from the housing will flow from the apertured pipes and out of the back wash pipes for clearing clogs in the holes in the apertured pipe;

quick release coupling assemblies between the housing and each apertured pipe, each coupling assembly including: a circular aperture in the housing for each apertured pipe in the central section adjacent to the lower section, a cylindrical interior component having an annular flange welded to each aperture and having an internal passageway in a frusto-conical configuration; an annular compression plate adjacent to each annular flange; a swedge with an interior portion positionable within each interior component, each swedge having an interior bore for receiving an apertured pipe and an exterior surface in a frusto-conical configuration larger than the internal passageway of the interior component, each swedge having an exterior portion in an annular configuration between the compression plate and the annular flange, the interior component and the compression plate being fabricated of a rigid metallic material, the swedge being fabricated of urethane; and aligned apertures in the compression plate and the swedge and the flange of the interior component, the apertures of the flange of the interior component being threaded, bolts releasably coupling the compression plate and the swedge to the flange of the interior component whereby tightening the bolts will compress the swedges for creating a water tight seal between the apertured pipes and the housing and whereby removing the bolts will allow for the quick release and uncoupling of the apertured pipes from the housing for repair or replacement.

* * * * *